US005692963A

United States Patent [19]

Holcombe

[11] Patent Number: 5,692,963

[45] Date of Patent: Dec. 2, 1997

[54] GOLF GAME

[76] Inventor: Donald Holcombe, 255 Williams Way, Elm Grove, La. 71051-8093

[21] Appl. No.: 675,589

[22] Filed: Jul. 3, 1996

[51] Int. Cl.[6] ..... A63B 69/36

[52] U.S. Cl. ..... 473/162; 473/158; 473/171; 473/185

[58] Field of Search ..... 273/157–163, 273/171, 185

[56] References Cited

U.S. PATENT DOCUMENTS

| | | | |
|---|---|---|---|
| 713,253 | 11/1902 | Taylor . | |
| 720,191 | 2/1903 | Taylor . | |
| 3,081,090 | 3/1963 | Congleton | 473/185 |
| 3,464,704 | 9/1969 | Nelson | 473/162 |
| 3,565,742 | 2/1971 | Stephens et al. | 473/171 |
| 3,604,710 | 9/1971 | Jacobs . | |
| 3,831,949 | 8/1974 | Henning | 473/158 |
| 3,909,006 | 9/1975 | Arbaugh | 473/185 |
| 4,108,440 | 8/1978 | Delaplaine . | |
| 4,114,889 | 9/1978 | Midana | 473/159 |
| 4,124,210 | 11/1978 | Mason . | |
| 4,861,033 | 8/1989 | Miner . | |
| 4,988,106 | 1/1991 | Coonrod | 473/162 |

*Primary Examiner*—Mark S. Graham
*Attorney, Agent, or Firm*—Morris, Manning & Martin LLP

[57] ABSTRACT

A golf game is disclosed which has disks for simulating holes which may be selectively positioned about the surface of a mat to alter the course layout. The mat may be marked with obstacles to simulate playing hazards. Additionally, a teeing disk may also be provided. The disks are preferably provided with fasteners to temporarily secure the disks to the mat for play. The fastener may be hook and loop, adhesive strip or a staple.

1 Claim, 1 Drawing Sheet

GOLF GAME

BACKGROUND OF THE INVENTION

Games simulating putting and devices adapted for putting practice are known. The devices adapted for putting practice have generally been intended for use on a rug or other available practice surface, while the games simulating putting have commonly been arranged on table top surfaces or resilient surfaces allowing for play with conventional golf playing implements or more toy-like playing implements.

U.S. Pat. No. 4,108,440 to Delaplaine is directed to a golf putting game provided in a mat of foam resilient material. The mat has holes cut in it to form putting cups and is also marked with areas indicating tees. The holes and teeing areas are marked with appropriate indicia indicating the sequence of play for the golf game. Further, the mat is reversible to provide a different course layout on each side.

U.S. Pat. Nos. 713,253 and 720,191, both issued to Taylor, show a golf game in which a course is provided on the surface of a game board with sides. The game board is covered with fuzzy material such as flock or felt. The game includes multiple holes cut out of the game board and tee grounds which are marked on the surface of the board. The patents disclose the use of a ball covered with a fuzzy material, smooth or serrated.

U.S. Pat. No. 3,604,710 to Jacobs is directed to an indoor golf putting game where the greens and playing surfaces are constructed from carpet laid upon a foundational material which may be cement, wood, or other suitable material. The holes for this game are cut through the carpet and foundational material. Different elevations for the playing surface and greens may be produced by placing material between the upper playing surface and the foundational material. The game also includes markers which indicate the teeing ground and the number for the hole being played. These markers are portable and may be moved toward or away from the hole to vary the length of a particular putt.

The games associated with the above patents have a playing surface or mat for playing the games and holes permanently cut out or fixed in the playing surface. The coarse layout does not change because the holes are permanently fixed to their respective locations in the coarse. What is needed is a putting game for playing on a suitable surface having holes which may be selectively positioned on the playing surface to alter the playing coarse layout.

SUMMARY OF THE INVENTION

The limitations of previously known golf games have been overcome by a game made in accordance with the principles of the present invention. Generally, the golf game of the present invention comprises a mat and a plurality of detachable disks representing holes so the detachable disks may be selectively positioned about the mat to change the layout of a simulated course.

More particularly, the mat of the present invention has a playing surface simulating a natural grass surface. The game also includes a plurality of detachable or portable disks which may be selectively positioned on the surface of the mat. The disks have an inlet for receiving a ball. Preferably, the disks are marked with indicia indicating the appropriate sequence of play. The game preferably includes a tee mounted to the mat for striking the ball therefrom. The tee may be affixed or selectively attachable to the mat. The portable disks are selectively moved about the mat altering a coarse layout.

In another embodiment of the invention, the mat is marked with obstacles simulating hazards during play. The surface of the mat may be artificial plastic grass, felt, flock, carpet, or any other woven surface simulating a natural grass surface. The inlet for the disks preferably joins with a recess which accepts and retains a ball being played. The ball of the present invention may be a marble, golf ball, or similarly sized rounded object.

Most preferably, four disks having a recess for receiving the ball are positioned on the mat presenting both diagonal and straight line shots across the mat to a disk. The disks are positioned at the comers of a rectangular mat.

DETAILED DESCRIPTION OF THE INVENTION

Figure 1:
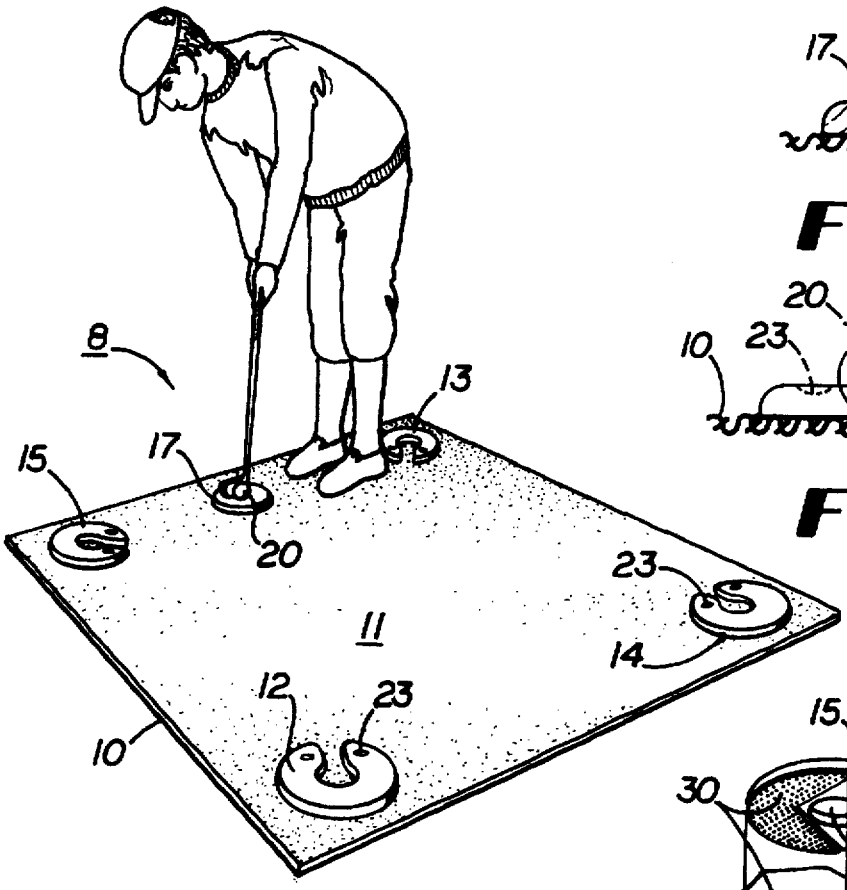
FIG. 1 is a perspective view of a player using the game of the present invention.

A golf game made in accordance with the principles of the present invention is shown in FIG. 1. The game 8 preferably includes a mat 10 having a playing surface 11 to simulate a natural grass putting surface and portable disks 12, 13, 14 and 15 for simulating holes of a putting green. The shape of the mat 10 may be any shape desired although a rectangular shape is most convenient because it will easily roll into a sleeve for storage or when not in use. Preferably, a teeing disk 17 is also mounted to the surface 11 of mat 10. Surface 11 may be felt, plastic grass, carpet or any other surface conducive for putting a rounded object. Preferably, the disks and teeing area are removably attached to mat 10. The disks may be a piece of wood or may be made of any other suitable material such as plastic, cardboard, or the like which can be easily configured to simulate a hole and be detachably secured to mat 10. Disks 12–15 (FIG. 2) are marked with indicia which indicate the sequence in which the holes are to be played. The disks are preferably formed with an inlet 24 and a recess 25 to receive and hold a ball or other round object.

Figure 3:
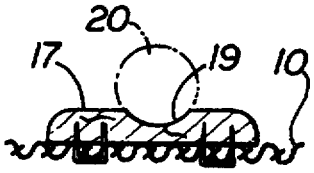
FIG. 3 is a cross sectional view taken along line 3—3 of FIG. 2.

Referring to FIG. 3, teeing area 17 is attached to mat 10. Although other materials and other shapes may be used to form tee 17, tee 17 is preferably a rounded piece of wood having one or more dimples 19 in its upper surface for receiving and holding rounded object 20 until it is struck. Object 20 is preferably a large marble, although other sizes and types of rounded objects are contemplated by this invention and can be placed on dimple 19 of tee 17, including regulation golf balls. Preferably, a golf club (putter) sized for children is used with game 8 to stroke the marble or ball 20 during play although regulation sized clubs may be used. The disks are also provided with dimples 23 to provide a tee ground for playing the next hole in sequence.

Figure 4:
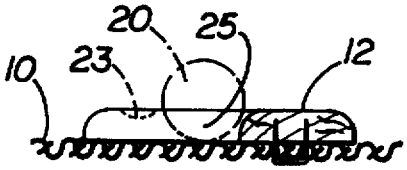
FIG. 4 is a cross sectional view taken along line 4—4 of FIG. 2.
Figure 5:
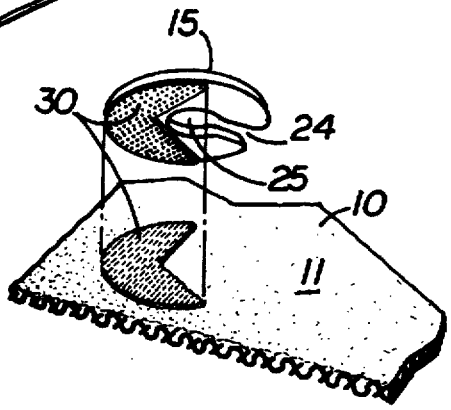
FIG. 5 is a perspective view of a preferred embodiment of a detachable disk used in accordance with the present invention.

Disks 12–15 may be mounted to mat 10 by a variety of methods. For example, as shown in FIG. 4, a mechanical fastener, such as staples, may be used to secure the disks to mat 10. Another type of mechanical fastener is a hook and loop fastener 30 attached to the underside of a disk as shown in FIG. 5. The fastener 30 grips surface 11 to detachably secure a disk to mat 10. Fastener 30 may cover the entire underside of a disk or it may be one or more strips mounted to a disk underside. Alternatively, the disks may be detachably mounted to mat 10 by using double-sided tape or the like.

Figure 2:
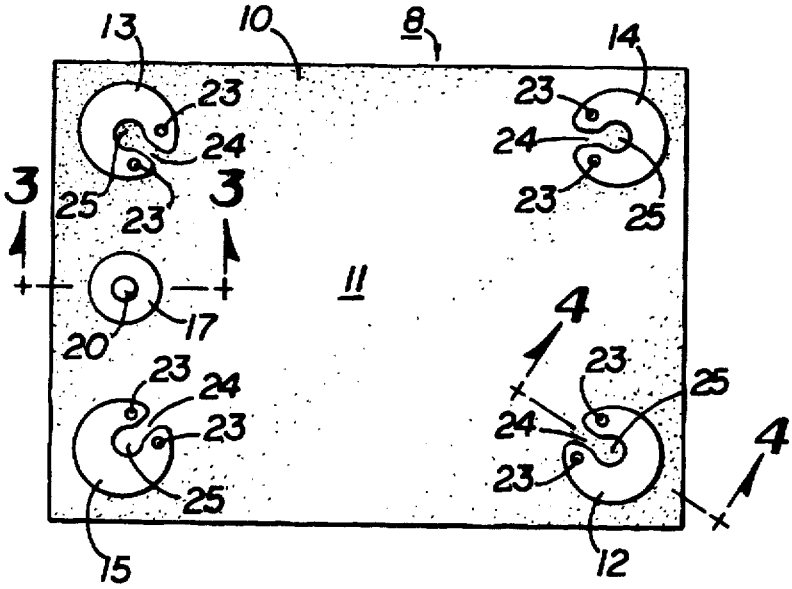
FIG. 2 is a plan view of the playing surface of the mat and the selected positions of holes used in the putting game of the present invention.

To play game 8, a player places a rounded object 20 on a dimple 19 of tee ground 17 and strokes object 20 towards disk 12 marked with the indicia "1". To "hole" object 20, the object must pass through inlet 24 so it comes to rest inside recessed opening 25 of disk 12. After a player holes object 20 in recess 25, the object is placed in dimple 23 of disk 12 and struck towards the next higher numbered disk, in this case disk 13 with the indicia "2". This sequence continues until all of the holes have been played. The disks representing the holes of game 8 are preferably arranged so that disks 12 and 13 are placed at the diagonals of rectangular mat 10 and disks 14 and 15 are placed on the crossing diagonal of mat 10. Tee ground 17 is placed approximately half way between disks 13 and 15. Thus, the shots to holes "2" and "4" are along a diagonal across mat 10 while the shots to holes "1" and "3" are shorter shots generally aligned with one side of mat 10. Alternatively, object 20 may be returned to tee area 17 after completion of each hole. This method of play provides "dog leg" shots as shown in FIG. 2. Game 8 may also include variations such as marking or mounting obstacles on mat 10 to simulate water hazards, sand traps, or the like. After all of the "holes" have been played, the player with the lowest number of total strokes wins.

The present invention has been described in detail above for purposes of illustration only and is not intended to be limited by this description or otherwise to exclude any variation or equivalent arrangement that would be apparent from or reasonably suggested by the foregoing disclosure to those skilled in the art.

What is claimed is:

1. A golf putting game comprising:

a mat having a playing surface simulating a natural grass surface;

a plurality of disks each having an inlet for receiving a ball, said disks being capable of being selectively positioned and secured in non-predesignated areas on said mat to alter a course layout for said golf putting game and wherein each of said disks are provided with a dimple to provide a tee ground for playing another hole.

* * * * *

UNITED STATES PATENT AND TRADEMARK OFFICE

CERTIFICATE OF CORRECTION

PATENT NO. : 5,692,963

DATED : December 2, 1997

INVENTOR(S) : Holcombe

It is certified that error appears in the above-identified patent and that said Letters Patent is hereby corrected as shown below:

column 1, line 46 should read "...playing surface to alter the playing course layout."
column 1, line 67 should read "...a course layout."

Signed and Sealed this

Second Day of June, 1998

*Attest:*

*Attesting Officer*

BRUCE LEHMAN

*Commissioner of Patents and Trademarks*